US011473233B2

(12) United States Patent
Yang et al.

(10) Patent No.: US 11,473,233 B2
(45) Date of Patent: Oct. 18, 2022

(54) ROTARY TUB ASSEMBLY FOR WASHING MACHINE AND WASHING MACHINE HAVING SAME

(71) Applicant: WUXI LITTLE SWAN ELECTRIC CO., LTD., Wuxi (CN)

(72) Inventors: Yao Yang, Wuxi (CN); Wei Zhou, Wuxi (CN); Zhangjing Li, Wuxi (CN)

( * ) Notice: Subject to any disclaimer, the term of this patent is extended or adjusted under 35 U.S.C. 154(b) by 214 days.

(21) Appl. No.: 16/768,861

(22) PCT Filed: Mar. 13, 2019

(86) PCT No.: PCT/CN2019/077910
§ 371 (c)(1),
(2) Date: Jun. 1, 2020

(87) PCT Pub. No.: WO2019/174587
PCT Pub. Date: Sep. 19, 2019

(65) Prior Publication Data

US 2022/0145519 A1 May 12, 2022

(30) Foreign Application Priority Data

Mar. 13, 2018 (CN) ..... 201820346493.8
Jan. 29, 2019 (CN) ..... 201910083643.X
Jan. 29, 2019 (CN) ..... 201920156920.0

(51) Int. Cl.
*D06F 39/08* (2006.01)
*D06F 23/04* (2006.01)
*D06F 37/12* (2006.01)
*D06F 37/24* (2006.01)

(52) U.S. Cl.
CPC ..... *D06F 39/088* (2013.01); *D06F 23/04* (2013.01); *D06F 37/12* (2013.01); *D06F 37/24* (2013.01); *D06F 39/083* (2013.01)

(58) Field of Classification Search
None
See application file for complete search history.

(56) References Cited

FOREIGN PATENT DOCUMENTS

| | | | |
|---|---|---|---|
| CN | 105568616 | A | 5/2016 |
| CN | 107142673 | A | 9/2017 |
| CN | 107475986 | A | 12/2017 |
| CN | 208266461 | U | 12/2018 |
| JP | 2013141508 | A | 7/2013 |

OTHER PUBLICATIONS

International Search Report dated May 30, 2019 corresponding to International Application No. PCT/CN2019/077910.
OA for IN application 202027030196.
OA for JP application 2020-523798.

*Primary Examiner* — Rita P Adhlakha
(74) *Attorney, Agent, or Firm* — Kilpatrick Townsend & Stockton, LLP

(57) ABSTRACT

A rotary tub assembly for a washing machine and a washing machine having the same. The rotary tub assembly includes: a rotary tub including a tub body having an inner diameter increased gradually from bottom to top, and having a water guide cover mounting portion formed at a circumferential wall, the water guide mounting portion protruding towards an outer side of the tub body; and a water guide cover provided at the water guide cover mounting portion, located in the rotary tub, and defining a water guide cavity having a water inlet and a water outlet, a liquid in the rotary tub rising under the action of a centrifugal force entering the water guide cavity via the water inlet and being discharged from the water outlet.

17 Claims, 6 Drawing Sheets

ROTARY TUB ASSEMBLY FOR WASHING MACHINE AND WASHING MACHINE HAVING SAME

CROSS-REFERENCES TO RELATED APPLICATIONS

The present disclosure is a national phase application of International Application No. PCT/CN2019/077910, filed on Mar. 13, 2019, which claims the priority of Chinese Application No. 201820346493.8 filed in the Chinese Patent Office on Mar. 13, 2018, Chinese Application No. 201920156920.0 and 201910083643.X filed on Jan. 29, 2019, the entireties of which are herein incorporated by reference.

FIELD

The present application relates to the field of electric appliance manufacturing technologies, and particularly to a rotary tub assembly for a washing machine and a washing machine having the same.

BACKGROUND

With a continuous development of washing machine technologies, a washing machine tends to have a large capacity which will inevitably increase an overall size thereof, and thus it is necessary to provide a washing machine having a small volume but a large capacity. Meanwhile, when the existing washing machine is washing, water is distributed in a rotary tub and a water tub. That is, water is also distributed between the water tub and the rotary tub, and water consumption is large, resulting in a waste of water resource. For the existing washing machine, dirt is prone to be left between the water tub and the rotary tub, which breeds bacteria; since the water is distributed between the water tub and the rotary tub, detergent is also used a lot, which causes a waste of the detergent and does not facilitate cost reduction.

To this end, in a related art, there is proposed a washing machine with the water tub omitted but only the rotary tub retained, and a water guide cover is provided at an inner circumferential wall surface of the rotary tub, and in a spinning process, the water in the rotary tub rises firstly under the action of a centrifugal force and then falls down and is discharged under gravity through the water guide cover. However, since the centrifugal force exists in the whole spinning process, consideration may not be given to influences of the centrifugal force on the water in the rising and falling processes, resulting in a poor spinning effect.

SUMMARY

The present application seeks to solve at least one of the problems existing in a prior art. For this purpose, the present application proposes a rotary tub assembly for a washing machine, and the rotary tub assembly has the advantages of a good spinning effect, or the like.

The present application further proposes a washing machine having the rotary tub assembly for the washing machine.

According to embodiments of a first aspect of the present application, there is provided a rotary tub assembly for a washing machine, including: a rotary tub including a tub body having an inner diameter increasing gradually from a bottom to a top, a water guide cover mounting portion being formed at a circumferential wall of the tub body, the water guide mounting portion protruding towards an outer side of the tub body; and a water guide cover provided at the water guide cover mounting portion, located in the rotary tub and defining a water guide cavity having a water inlet and a water outlet, a liquid in the rotary tub rising under an action of a centrifugal force entering the water guide cavity via the water inlet and being discharged through the water outlet.

With the rotary tub assembly for the washing machine according to the embodiment of the present application, by setting the inner diameter of the tub body to be increased gradually from bottom to top, the water may be facilitated to rise to enter the water guide cover, having the advantages of the good spinning effect, or the like.

The rotary tub assembly for the washing machine according to the embodiment of the present application may further have the following additional features.

According to some embodiments of the present application, a distance between a contour line of the tub body at the water guide cover mounting portion in an up-down direction and a contour line of the tub body at any other position in the up-down direction increases from a top to a bottom.

According to some embodiments of the present application, an inner diameter of the water guide cover mounting portion at any one position is not less than an inner diameter of a portion of the water guide cover mounting portion located above the position.

Further, an inner diameter of the water guide cover mounting portion is consistent at each position in an up-down direction.

Further, an inner diameter of the water guide cover mounting portion increases from a top to a bottom.

According to some embodiments of the present application, the tub body and the water guide cover mounting portion are configured as an integrated part.

According to some embodiments of the present application, the water inlet is provided at the water guide cover, and the water outlet is provided at the water guide cover mounting portion and/or a bottom wall of the tub body.

Further, the water inlet is provided at an upper portion of the water guide cover, and the water outlet is provided at a lower portion of the water guide cover mounting portion.

Further, the water inlet is provided at an upper end of the water guide cover, and the water outlet is adjacent to the bottom wall of the tub body.

According to some embodiments of the present application, the water guide cavity of the water guide cover is defined merely by the water guide cover or by both the water guide cover and the water guide cover mounting portion.

According to some embodiments of the present application, a plurality of water guide cover mounting portions are provided and spaced apart from each other in a circumferential direction of the tub body, and a plurality of water guide covers are provided at the plurality of water guide cover mounting portions respectively.

According to embodiments of a second aspect of the present application, a washing machine is provided, including: a cabinet; and the rotary tub assembly for the washing machine according to the embodiments of the first aspect of the present application, the rotary tub assembly being rotatably provided in the cabinet.

With the rotary tub assembly for the washing machine according to the embodiment of the first aspect of the present application, the washing machine according to the embodiment of the present application has the advantages of the good spinning effect, or the like.

According to some embodiments of the present application, the washing machine further includes a balance ring provided at and connected to an upper end of the tub body, and being adjacent to or connected to an upper end of the water guide cover, the water inlet being provided at the upper end of the water guide cover.

According to some embodiments of the present application, the washing machine further includes a drain pan provided in the cabinet and having at least a part located below the rotary tub, the water guide cavity guiding a liquid spun out by the rotary tub to the drain pan via the water outlet.

Further, the washing machine further includes an impeller rotatably provided in the rotary tub.

Further, the washing machine further includes a drive unit configured to drive at least one of the rotary tub and the impeller to rotate and mounted at the drain pan.

Additional aspects and advantages of the present application will be given in part in the following descriptions, become apparent in part from the following descriptions, or be learned from the practice of the present application.

BRIEF DESCRIPTION OF THE DRAWINGS

The above-mentioned and/or additional aspects and advantages of the present application will become apparent and more readily appreciated from the following descriptions of the embodiments made with reference to the drawings, in which.

DETAILED DESCRIPTION OF THE DISCLOSURE

Figure 1:
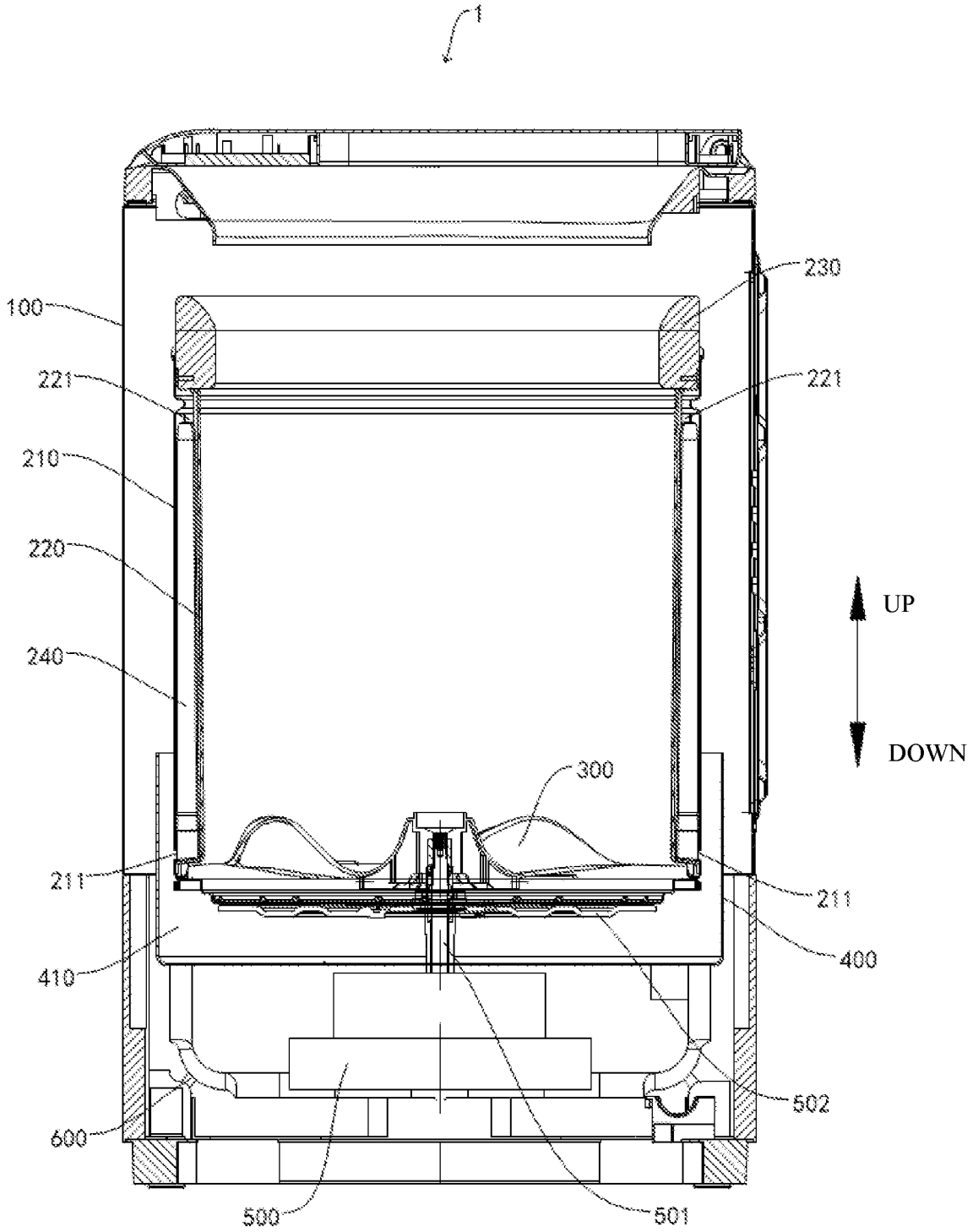
FIG. 1 is a sectional view of a washing machine according to an embodiment of the present application.

Reference will be made in detail to embodiments of the present application, and the examples of the embodiments are illustrated in the drawings, and the same or similar elements and the elements having same or similar functions are denoted by like reference numerals throughout the descriptions. The embodiments described herein with reference to drawings are illustrative, and merely used to explain the present application. The embodiments shall not be construed to limit the present application.

In the description of the present application, it is to be understood that terms such as "upper", "lower", "vertical", "horizontal", "top", "bottom", "inner", "outer", "radial", and "circumferential" should be construed to refer to the orientation as then described or as shown in the drawings under discussion. These relative terms are for convenience of description and do not require that the present application be constructed or operated in a particular orientation, thus cannot be construed to limit the present application. Furthermore, in the description of the present disclosure, the term "a plurality of" means two or more unless otherwise stated.

In the description of the present disclosure, it should be noted that unless specified or limited otherwise, the terms "mounted", "connected", and "coupled" and the like are used broadly, and may be, for example, fixed connections, detachable connections, or integral connections; may also be mechanical connections or electrical connections; may also be direct connections or indirect connections via intervening structures; may also be inner communications of two elements.

A rotary tub assembly 200 for a washing machine according to an embodiment of the present application will be described below with reference to accompanying drawings.

As shown in FIGS. 1 to 7, the rotary tub assembly 200 for a washing machine according to the embodiment of the present application includes a rotary tub 210 and a water guide cover 220.

The rotary tub 210 includes a tub body 250 having an inner diameter increased gradually from bottom to top, and having a water guide cover mounting portion 260 formed at a circumferential wall, the water guide mounting portion 260 protruding towards an outer side of the tub body 250. The tub body 250 has the inner diameter D increased gradually from bottom to top. That is, the tub body 250 may be configured into a shape of big end up cone. The water guide cover 220 is provided at the water guide cover mounting portion 260 and located in the rotary tub 210, and defines a water guide cavity 240 having a water inlet 221 and a water outlet 211, and the liquid in the rotary tub 210 rising under the action of a centrifugal force enters the water guide cavity 240 via the water inlet 221 and is discharged from the water outlet 211.

With the rotary tub assembly 200 for the washing machine according to the embodiment of the present application, the water guide cover mounting portion 260 is configured at the inner circumferential wall of the tub body 250, the water guide cover 220 is mounted at the water guide cover mounting portion 260 and located in the tub body 250, and when the tub body 250 is rotating, the water in the tub body 250 rises along the inner circumferential wall of the tub body 250 under the action of the centrifugal force, enters the water guide cavity 240 via the water inlet 221, flows downwards under gravity and is discharged from the water outlet 211, and a water tub is not required to be provided at the rotary tub 210, simplifying a structure of the rotary tub assembly 200. Furthermore, by setting the inner diameter of the tub body 250 to be increased gradually from bottom to top, the water may be facilitated to rise to enter the water guide cover 220, improving a spinning effect.

Figure 5:
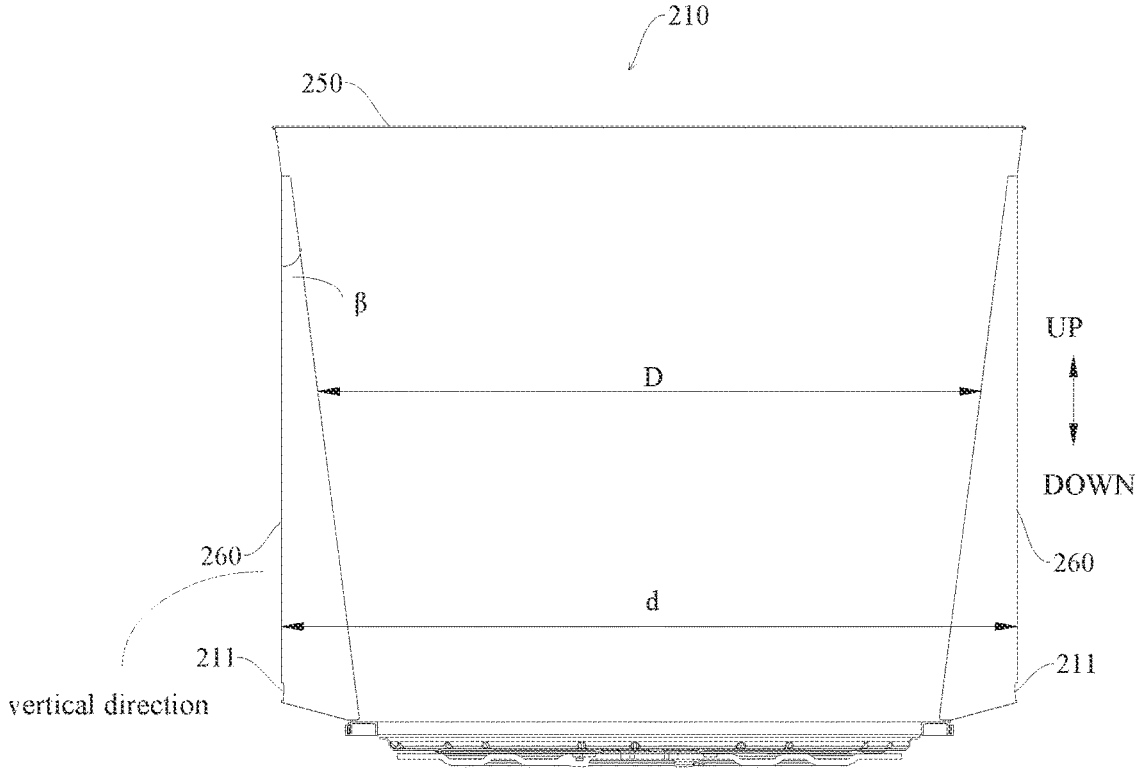
FIG. 5 is a sectional view of the rotary tub of the rotary tub assembly for the washing machine according to the embodiment of the present application.
Figure 6:
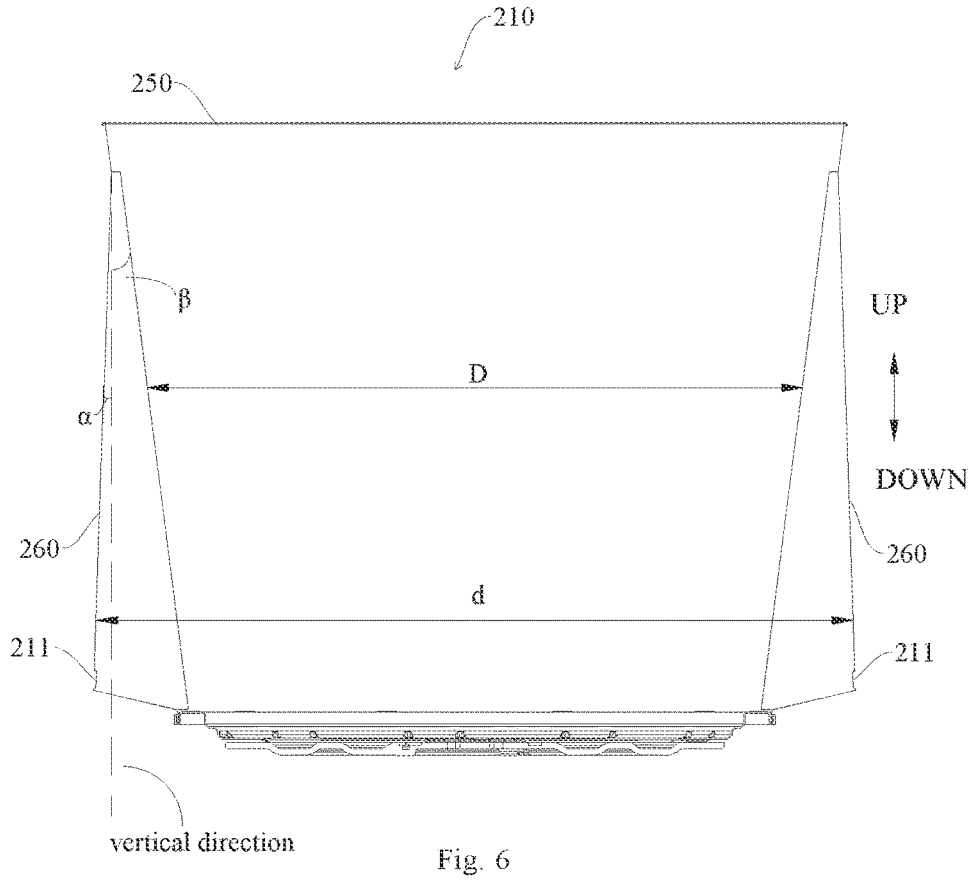
FIG. 6 is a sectional view of a rotary tub of a rotary tub assembly for a washing machine according to some other embodiments of the present application.
Figure 7:
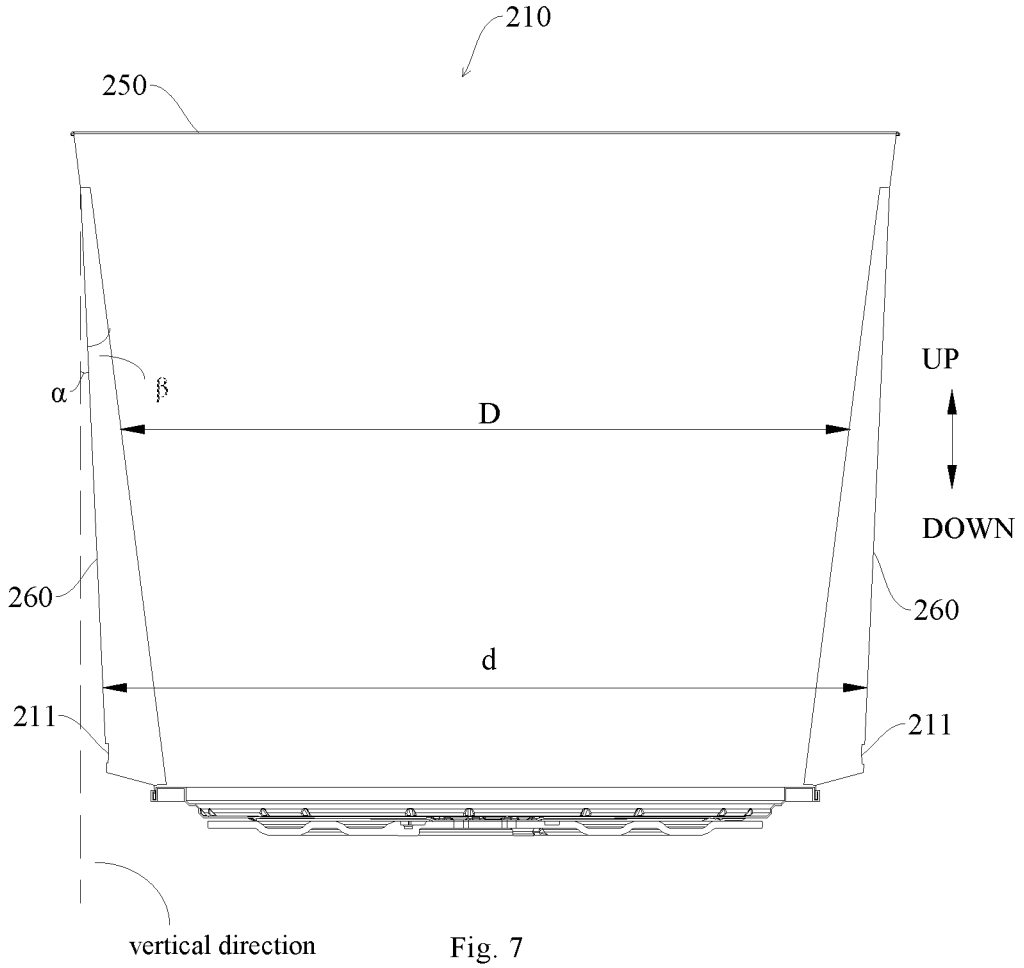
FIG. 7 is a sectional view of a rotary tub of a rotary tub assembly for a washing machine according to still further embodiments of the present application.

In some embodiments of the present application, as shown in FIGS. 5 to 7, a distance increased gradually from top to bottom exists between a contour line of the tub body 250 at the water guide cover mounting portion 260 in an up-down direction and a contour line of the tub body 250 at any other position in the up-down direction.

In some embodiments, an included angle $\alpha$ between the water guide cover mounting portion 260 and a vertical direction (i.e., the up-down direction) is less than an included angle between the circumferential wall of the tub body 250 and the vertical direction.

It should be appreciated that the circumferential wall of the tub body 250 obliquely extends inwards gradually from top to bottom relative to the vertical direction, and assuming that a positive included angle is present between the contour line formed by the circumferential wall of the tub body 250 from top to bottom and the vertical direction, the included angle α between the water guide cover mounting portion 260 and the vertical direction is less than the included angle between the circumferential wall of the tub body 250 and the vertical direction, including the cases where the included angle α between the water guide cover mounting portion 260 and the vertical direction is positive, zero and negative.

In the embodiments of the present application, both the contour line of the tub body 250 at the water guide cover mounting portion 260 in the up-down direction and the contour line of the tub body 250 at any other position in the up-down direction are straight lines, and since the tub body 250 is configured into the shape of big end up cone, the contour line of the tub body 250 at the water guide cover mounting portion 260 in the up-down direction may be formed into a vertical line extending in the up-down direction in FIG. 5, or an oblique straight line obliquely extending outwards gradually from top to bottom relative to the up-down direction in FIG. 6, or an oblique straight line obliquely extending inwards gradually from top to bottom relative to the up-down direction in FIG. 7.

An inner diameter d of the water guide cover mounting portion 260 refers to the inner diameter of the tub body 250 at the water guide cover mounting portion 260, and both a measurement starting point and a measurement ending point of the inner diameter d herein are located at an inner side wall of the water guide cover mounting portion 260. The inner diameter D of the tub body refers to an inner diameter of a portion of the tub body 250 other than the water guide cover mounting portion 260, and both measurement starting and ending points of the inner diameter D herein are located at an inner side wall of the portion of the tub body 250 other than the water guide cover mounting portion 260. It should be noted that the inner diameter d shown in FIGS. 5 to 7 excludes a wall thickness at the water guide cover mounting portion 260, and the inner diameter D excludes a wall thickness of the portion of the tub body 250 other than the water guide cover mounting portion 260.

In some embodiments of the present application, as shown in FIG. 7, the inner diameter d of the water guide cover mounting portion 260 may be increased gradually from bottom to top. That is, a positive included angle is present between the water guide cover mounting portion 260 and the vertical direction, the inner diameter of an upper end of the water guide cover mounting portion 260 may be greater than or equal to an inner diameter of a portion of the tub body 250 located at the same height as the upper end of the water guide cover mounting portion 260, and the inner diameters of any other portions of the water guide cover mounting portion 260 are greater than the inner diameter of the portions of the tub body 250 located at the same height as the portions. That is, in a radial direction of the rotary tub 210, the portions of the water guide cover mounting portion 260 other than the upper end are located at the outer side of the circumferential wall of the tub body 250, in which example, the positive included angle is present between the water guide cover mounting portion 260 and the vertical direction. That is, a direction in which the water guide cover mounting portion 260 slants relative to the vertical direction is the same as a direction in which the circumferential wall of the tub body 250 slants relative to the vertical direction.

According to some other embodiments of the present application, an inner diameter of at any one position is not less than an inner diameter of a portion located above the position. That is to say, the inner diameter of the water guide cover mounting portion 260 at each position is not less than the inner diameter of the portion of the water guide cover mounting portion 260 located above the position.

For example, as shown in FIG. 5, the water guide cover mounting portion 260 may also extend vertically in the up-down direction. That is, the included angle of zero degree is present between the water guide cover mounting portion 260 and the vertical direction, and the water guide cover mounting portion 260 at each position in the up-down direction may have a consistent inner diameter d.

For another example, as shown in FIG. 6, the inner diameter d of the water guide cover mounting portion 260 may also be increased gradually from top to bottom. That is, in the radial direction of the rotary tub 210, a lower end of the water guide cover mounting portion 260 may be located at an outer side of the upper end of the water guide cover mounting portion 260, in which example, the negative included angle α exists between the water guide cover mounting portion 260 and the vertical direction. That is, the direction in which the water guide cover mounting portion 260 slants relative to the vertical direction is opposite to the direction in which the circumferential wall of the tub body 250 slants relative to the vertical direction.

It may be appreciated that in a cross section of the rotary tub assembly 200, the water guide cover mounting portion 260 has an arc shape concentric with the tub body 250, and thus the inner diameter of the water guide cover mounting portion 260 is a diameter of the arc where an inner side surface thereof is located.

The tub body 250 and the water guide cover mounting portion 260 are configured as an integrated part. That is, the tub body 250 and the water guide cover mounting portion 260 are integrally formed, which not only facilitates processing, but also has a better sealing performance and a higher structural strength.

The water guide cover 220 is provided at the water guide cover mounting portion 260 and located in the rotary tub 210, and defines a water guide cavity 240 having a water inlet 221 and a water outlet 211. The liquid in the rotary tub 210 rising under the action of the centrifugal force enters the water guide cavity 240 via the water inlet 221 and is discharged from the water outlet 211.

Specifically, when the washing machine 1 is spinning, the rotary tub 210 rotates. That is, the water guide cover 220 rotates with the tub body 250, the liquid in the rotary tub 210 moves upwards under the action of the centrifugal force and enters the water guide cavity 240 via the water inlet 221, and the liquid entering the water guide cavity 240 is guided to the water outlet 211 by the water guide cover 220 and discharged from the water outlet 211.

Figure 2:
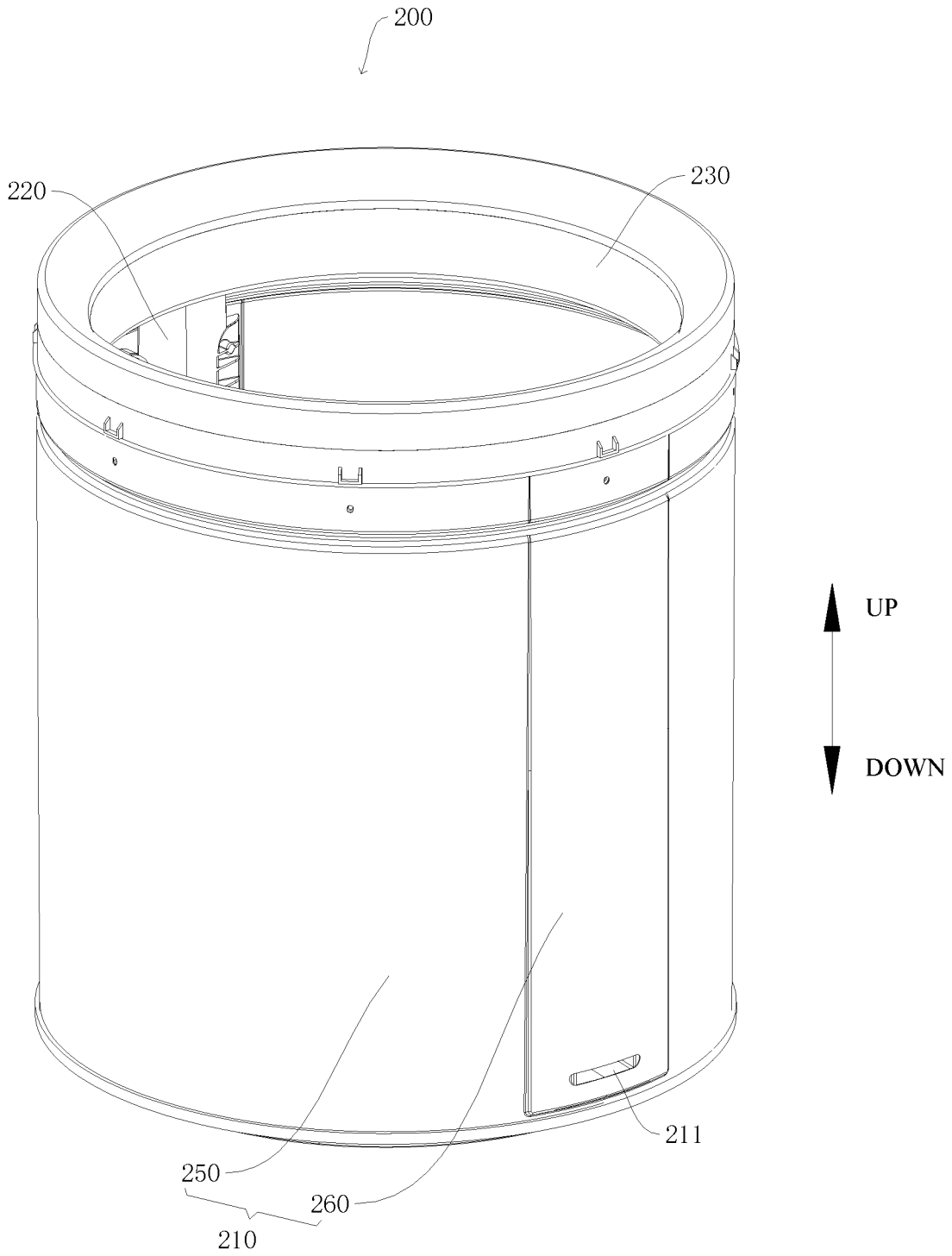
FIG. 2 is a schematic structural diagram of a rotary tub assembly for a washing machine according to an embodiment of the present application.
Figure 3:
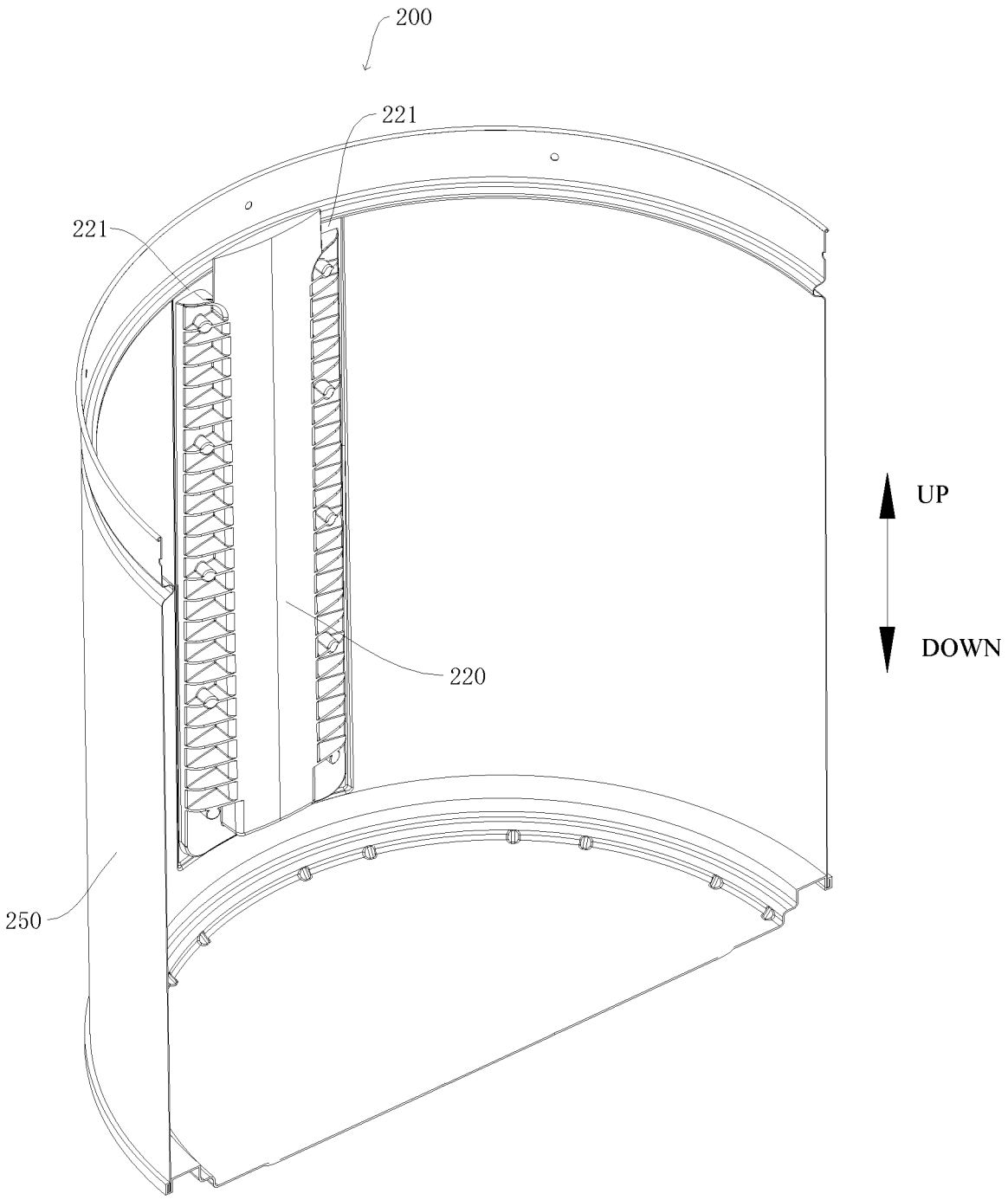
FIG. 3 is a schematic partial structural diagram of the rotary tub assembly for the washing machine according to the embodiment of the present application.
Figure 4:
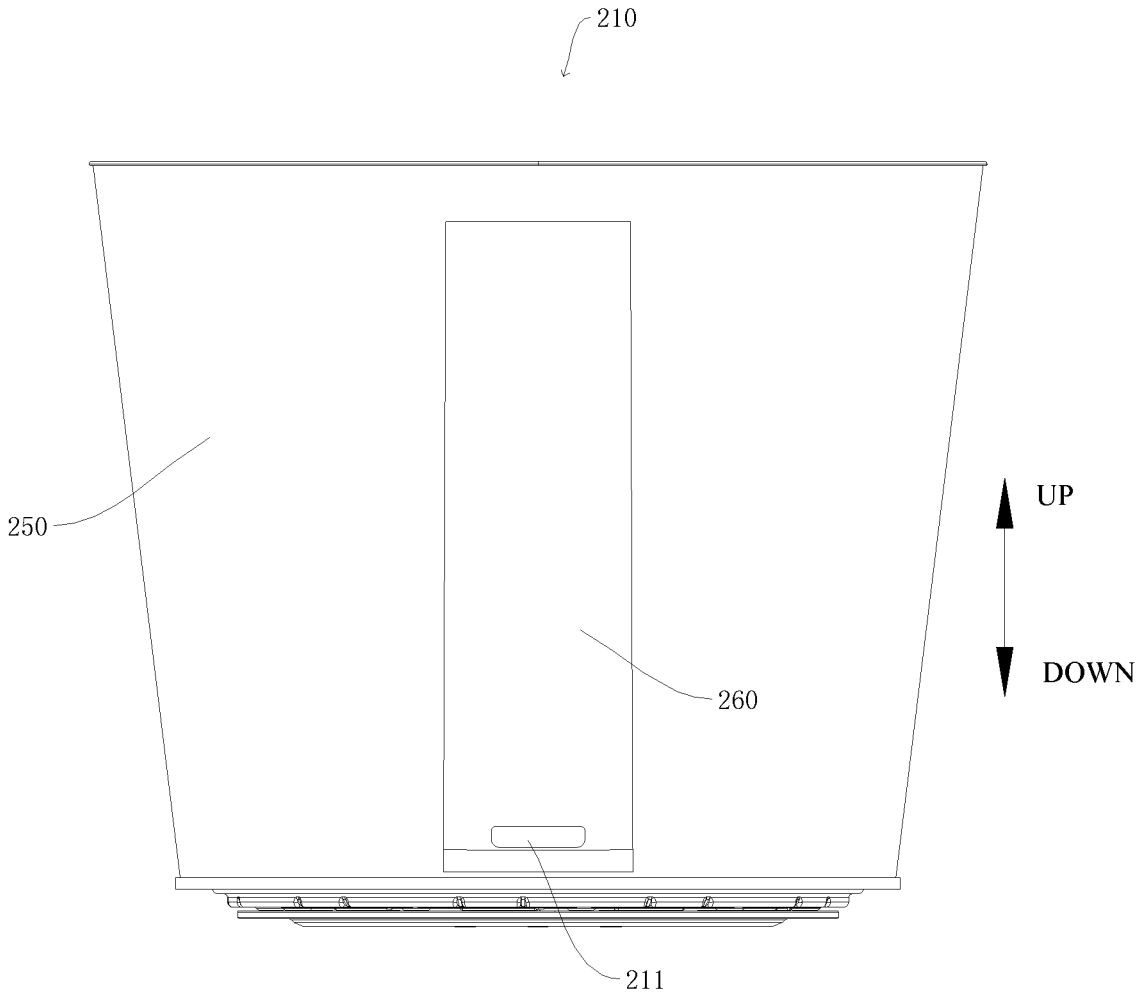
FIG. 4 is a schematic structural diagram of a rotary tub of the rotary tub assembly for the washing machine according to the embodiment of the present application.

According to some embodiments, the examples of FIGS. 1 to 3, since the inner diameter D of the tub body 250 has a small difference in the up-down direction, it is difficultly observed clearly in the drawings that the tub body 250 has the inner diameter D increased gradually from bottom to top, but the structural feature of the tub body 250 may be shown more clearly in the examples shown in FIGS. 4 to 6.

In the related art, usually, the rotary tub of a washing machine with an impeller is a straight drum having a consistent inner diameter or a drum having a shape of big end up cone, and since a portion with the larger inner diameter has the larger centrifugal force correspondingly when the rotary tub rotates, a portion with the smaller inner diameter has the smaller centrifugal force correspondingly. Thus, for the straight drum, the water rises difficultly during the spinning period, for the conical drum, the water falls down difficultly during the spinning period, and in both above-mentioned cases, the spinning effect is affected.

With the rotary tub assembly 200 for the washing machine according to the embodiment of the present application, by setting the inner diameter of the tub body 250 to be increased gradually from bottom to top, during the spinning period, the water in the rotary tub 210 rises more easily to enter the water guide cavity 240 via the water inlet 221, the included angle between the water guide cover mounting portion 260 and the vertical direction is less than the included angle between the circumferential wall of the tub body 250 and the vertical direction, and the inner diameter of the water guide cover mounting portion 260 at any one position is set to be not less than the inner diameter of the portion located above the position, and the water entering the water guide cavity 240 may flow out of the water outlet 211 smoothly, without being limited by the centrifugal force.

Thus, the rotary tub assembly 200 for the washing machine according to the embodiment of the present application may consider the influences of the centrifugal force on the water both in the rising and falling processes, having the advantages of the good spinning effect, or the like.

In some embodiments of the present application, as shown in FIGS. 1 to 4, the water inlet 221 is provided at the water guide cover 220, and the water outlet 211 is provided at the water guide cover mounting portion 260 and/or a bottom wall of the tub body 250. That is, the water outlet 211 may be provided at the water guide cover mounting portion 260 or the bottom wall of the tub body 250, or the water outlet 211 is provided at the water guide cover mounting portion 260 and the tub body 250.

Specifically, the water outlet 211 is provided at the water guide cover mounting portion 260, and the water outlet 211 is covered with the water guide cover 220, and the lower end of the water guide cover 220 is only connected to the water guide cover mounting portion 260, which facilitates seal of the water guide cover 220. In one embodiment, the water outlet 211 in the present application may also be provided at the bottom wall of the tub body 250 and covered with the water guide cover 220, which facilitates increase in a spinning efficiency, has the good spinning effect, and may reduce splashed water from the water outlet 211 effectively. The water outlet 211 is provided at the water guide cover mounting portion 260 and the bottom wall of the tub body 250, which facilitates the seal of the water guide cover 220 and the increase in the spinning efficiency, and may prevent the water from being splashed from the water outlet 211 effectively.

Further, as shown in FIGS. 1 to 4, the water inlet 221 is provided at an upper portion of the water guide cover 220, and the water outlet 211 is provided at a lower portion of the water guide cover mounting portion 260. It may be appreciated herein that the upper portion of the water guide cover 220 refers to a portion of the water guide cover 220 located above a center in the up-down direction, and the lower portion of the water guide cover mounting portion 260 refers to a portion of the water guide cover mounting portion 260 located below the center in the up-down direction. Thus, during the spinning period, the rotary tub 210 rotates, the water in the rotary tub 210 rises under the action of the centrifugal force, and the rising water may be collected better by the water inlet 221 located at the upper portion of the water guide cover 220, enters the water guide cover 220 via the water inlet 221 and is guided by the water guide cover 220 to flow to the water outlet 211 at the lower portion, further increasing the spinning efficiency and the spinning effect.

Further, as shown in FIGS. 1 to 4, the water inlet 221 is provided at the upper end of the water guide cover 220, to further conveniently collect the liquid in the rotary tub 210 rising to the upper end of the rotary tub 210 under the action of the centrifugal force. The water outlet 211 is provided at the water guide cover mounting portion 260 adjacent to the bottom wall of the tub body 250, and spaced apart from the bottom wall of the tub body 250 by a predetermined distance, thus facilitating the seal of the water guide cover 220.

In one embodiment, the water guide cavity 240 of the water guide cover 220 is defined merely by the water guide cover 220 or by both the water guide cover 220 and the water guide cover mounting portion 260. In other words, one integral water guide cavity 240 may be defined in the water guide cover 220, and a through hole is defined in the water guide cover 220 and enables the water guide cavity 240 to be in communication with the water outlet 211. Or, the water guide cavity 240 with an open side is defined in the water guide cavity 220, and when the water guide cover 220 is mounted at the water guide cover mounting portion 260, the open side of the water guide cavity 240 is sealed by the water guide cover mounting portion 260.

In some embodiments of the present application, as shown in FIGS. 1 to 6, in order to improve a drainage effect of the washing machine 1, a plurality of water guide cover mounting portions 260 are provided at intervals in the circumferential direction of the tub body 250, and a plurality of water guide covers 220 are provided at the plural water guide cover mounting portions 260 respectively. That is, the number of water guide cover mounting portions 260 corresponds to the number of water guide covers 220, and each water guide cover mounting portion 260 is provided with the water guide cover 220. For example, two water guide cover mounting portions 260 are provided oppositely in the radial direction of the tub body 250, and two water guide covers 220 are provided in one-to-one correspondence at the two water guide cover mounting portions 260 respectively.

A washing machine 1 according to an embodiment of the present application will be described below with reference to the accompanying drawings.

As shown in FIGS. 1 to 6, the washing machine 1 according to the embodiment of the present application includes a cabinet 100 and the rotary tub assembly 200.

The rotary tub assembly 200 is rotatably provided in the cabinet 100.

The washing machine 1 according to the embodiment of the present application has a single drum. That is, only the rotary tub 210 is provided, without providing a water tub, and the water is in the rotary tub 210 during a washing period, which saves more water. By further providing the water guide cover 220 at an inner circumferential wall surface of the rotary tub 210 and defining the water guide cavity 240 having the water inlet 221 and the water outlet 211 in the water guide cover 220, the water in the rotary tub 210 rises under the action of the centrifugal force during the spinning period, enters the water guide cover 200 via the water inlet 221, and is guided by the water guide cover 220 to flow to the water outlet 211, being discharged from the water outlet 211. Thus, in the case of omitting the water tub to simplify the structure, increase a capacity, reduce dirt and bred bacteria and save water, the spinning effect may be improved.

In addition, the water guide cover 220 is connected onto the rotary tub 210, without providing an additional structure at the cabinet 100 or setting the cabinet 100 into a dual layer structure with an inner layer and an outer layer to guide the water in the spinning process, and no limitation is present on material selection of the cabinet 100. For example, the cabinet may be made of a material, such as a metal plate, or the like, improving an appearance greatly.

Furthermore, with the rotary tub assembly 200 according to the embodiment of the present application, consideration may be given to the influences of the centrifugal force on the water in the rising and falling processes, having the advantages of the good spinning effect, or the like.

In one embodiment, the rotary tub assembly 200 for the washing machine according to the embodiment of the present application may be applied to a single drum washing machine or a dual drum washing machine, which is not limited in the present application.

In some examples of the present application, as shown in FIG. 1, the washing machine 1 according to the embodiment of the present application includes the cabinet 100, the rotary tub assembly 200, the impeller 300, the drain pan 400, the drive unit 500 and a support damping assembly 600.

The impeller 300 is rotatably provided in the rotary tub 210. The drain pan 400 is provided in the cabinet 100, has at least a part located below the rotary tub 210 and is configured to support the rotary tub 210 directly or indirectly. In the present embodiment, the drive unit 500 is mounted at the drain pan 400, for example, at a lower surface of the drain pan 400, and configured to drive at least one of the rotary tub 210 and the impeller 300 to rotate. The drive unit 500 is provided with a drive shaft assembly 501 penetrating through and connectedly fitted with the drain pan 400, and a support plate 502 connected to the drive shaft assembly 501 is provided between the drain pan 400 and the rotary tub 210, and connected to the rotary tub 210 fixedly. The water guide cavity 240 guides the liquid spun out of the rotary tub 210 to the drain pan 400 via the water outlet 211. A drain groove 410 may be provided in the drain pan 400, a drainage port is provided at the lowest position of the drain groove 410 for drainage; the drain pan 400 may also not be provided with the drainage port, and the water in the drain groove 410 is extracted through a conduit, or the like. The support damping assembly 600 is mounted in the cabinet 100 and connected to the drain pan 400.

Thus, the drain pan 400 may receive the liquid discharged from the water guide cavity 240, and the drive unit 500 and the support damping assembly 600 may be mounted at the drain pan 400, to realize the functions of bearing the drive unit 500 and supporting the rotary tub 210.

Further, as shown in FIGS. 1 and 2, the washing machine 1 further includes a balance ring 230 configured to keep the rotary tub 210 balanced during rotation, provided at and connected to the upper end of the tub body 250, and adjacent to and spaced apart from the upper end of the water guide cover 220, such a gap enabling the water guide cover 220 to be mounted conveniently, and the water inlet 221 being provided at the upper end of the water guide cover 220. Thus, the water inlet 221 is located below the balance ring 230 and the water inlet 221 and the balancing ring 230 are not in contact with each other. Further, when the rotary tub 210 rotates, the water in the rotary tub 210 is facilitated to enter the water inlet 221 under the action of the centrifugal force, entering the water guide cavity 240. The upper end of the water guide cover 220 may also be connected to the balance ring 230, and the water inlet 221 is defined by the balance ring 230 and the upper end of the water guide cover 220, and when the rotary tub 210 rotates, the water in the rotary tub 210 is facilitated to enter the water inlet 221 under the action of the centrifugal force, entering the water guide cavity 240.

Other components and operations of the washing machine 1 according to the embodiment of the present application are also possible, and are not described in detail herein.

In the description of the present specification, reference throughout this specification to "one embodiment", "some embodiments", "exemplary embodiment", "example", "specific example", "some examples" or the like means that a particular feature, structure, material, or characteristic described in connection with the embodiment or example is included in at least one embodiment or example of the present application. In the specification, the schematic expressions to the above-mentioned terms are not necessarily referring to the same embodiment or example. Furthermore, the described particular features, structures, materials, or characteristics may be combined in any suitable manner in one or more embodiments or examples.

What is claimed is:

1. A rotary tub assembly for a washing machine, comprising:

a rotary tub comprising a tub body having an inner diameter increasing gradually from a bottom to a top, a water guide cover mounting portion being formed at a circumferential wall of the tub body, and the water guide mounting portion protruding towards an outer side of the tub body; and a water guide cover provided at the water guide cover mounting portion and located in the rotary tub, and defining a water guide cavity having a water inlet and a water outlet such that a liquid in the rotary tub rises under an action of a centrifugal force, enters the water guide cavity via the water inlet and is discharged through the water outlet;

wherein an angle $\alpha$ between the water guide cover mounting portion and a vertical direction is less than an angle $\beta$ between the circumferential wall of the tub body and the vertical direction.

2. The rotary tub assembly for a washing machine according to claim 1, wherein a distance between a contour line of the tub body at the water guide cover mounting portion in an up-down direction and a contour line of the tub body at any other position in the up-down direction increases from a top to a bottom.

3. The rotary tub assembly for a washing machine according to claim 1, wherein an inner diameter of the water guide cover mounting portion at any one position is not less than an inner diameter of a portion of the water guide cover mounting portion located above the position.

4. The rotary tub assembly for a washing machine according to claim 1, wherein an inner diameter of the water guide cover mounting portion is consistent at each position in an up-down direction.

5. The rotary tub assembly for a washing machine according to claim 1, wherein an inner diameter of the water guide cover mounting portion increases from a top to a bottom.

6. The rotary tub assembly for a washing machine according to claim 1, wherein the tub body and the water guide cover mounting portion are configured as an integrated part.

7. The rotary tub assembly for a washing machine according to claim 1, wherein the water inlet is provided at the water guide cover, and the water outlet is provided at the water guide cover mounting portion and/or a bottom wall of the tub body.

8. The rotary tub assembly for a washing machine according to claim 7, wherein the water inlet is provided at an upper portion of the water guide cover, and the water outlet is provided at a lower portion of the water guide cover mounting portion.

9. The rotary tub assembly for a washing machine according to claim 8, wherein the water inlet is provided at an upper end of the water guide cover, and the water outlet is adjacent to the bottom wall of the tub body.

10. The rotary tub assembly for a washing machine according to claim 1, wherein the water guide cavity of the water guide cover is defined merely by the water guide cover or by both the water guide cover and the water guide cover mounting portion.

11. The rotary tub assembly for a washing machine according to claim 1, wherein a plurality of water guide cover mounting portions are provided and spaced apart from each other in a circumferential direction of the tub body, and a plurality of water guide covers are provided at the plurality of water guide cover mounting portions respectively.

12. A washing machine, comprising:

a cabinet; and the rotary tub assembly for the washing machine according to claim 1, the rotary tub assembly being rotatably provided in the cabinet.

13. The washing machine according to claim 12, further comprising:

a balance ring provided at and connected to an upper end of the tub body, and adjacent to or connected to an upper end of the water guide cover, the water inlet being provided at the upper end of the water guide cover.

14. The washing machine according to claim 12, further comprising:

a drain pan provided in the cabinet and having at least a part located below the rotary tub, the water guide cavity guiding a liquid spun out by the rotary tub to the drain pan via the water outlet.

15. The washing machine according to claim 14, further comprising:

an impeller rotatably provided in the rotary tub.

16. The washing machine according to claim 15, further comprising:

a drive unit configured to drive at least one of the rotary tub and the impeller to rotate and mounted at the drain pan.

17. The rotary tub assembly for a washing machine according to claim 1, wherein the angle $\beta$ is positive, the angle $\alpha$ is positive, zero or negative.

* * * * *